US010808303B2

(12) United States Patent
Hüttner et al.

(10) Patent No.: US 10,808,303 B2
(45) Date of Patent: Oct. 20, 2020

(54) COPPER-NICKEL-ZINC ALLOY AND USE THEREOF

(71) Applicant: WIELAND-WERKE AG, Ulm (DE)

(72) Inventors: Susanne Hüttner, Neu-Ulm (DE); Timo Allmendinger, Blaustein (DE)

(73) Assignee: WIELAND-WERKE AG, Ulm (DE)

( * ) Notice: Subject to any disclaimer, the term of this patent is extended or adjusted under 35 U.S.C. 154(b) by 260 days.

(21) Appl. No.: 15/767,523

(22) PCT Filed: Oct. 12, 2016

(86) PCT No.: PCT/EP2016/001697

§ 371 (c)(1),
(2) Date: Apr. 11, 2018

(87) PCT Pub. No.: WO2017/084731

PCT Pub. Date: May 26, 2017

(65) Prior Publication Data

US 2018/0291484 A1 Oct. 11, 2018

(30) Foreign Application Priority Data

Nov. 17, 2015 (DE) ..... 10 2015 014 856

(51) Int. Cl.

| | |
|---|---|
| ***C22C 30/02*** | (2006.01) |
| ***C22C 9/04*** | (2006.01) |
| ***C22F 1/08*** | (2006.01) |
| ***C22C 30/06*** | (2006.01) |
| ***C22C 30/04*** | (2006.01) |

(52) U.S. Cl.

CPC ..... *C22C 30/02* (2013.01); *C22C 9/04* (2013.01); *C22C 30/04* (2013.01); *C22C 30/06* (2013.01); *C22F 1/08* (2013.01)

(58) Field of Classification Search

CPC .. C22C 9/04; C22C 9/06; C22C 30/02; C22C 30/06; C22C 30/04

See application file for complete search history.

(56) References Cited

U.S. PATENT DOCUMENTS

| | | | |
|---|---|---|---|
| 5,326,646 | A | 7/1994 | Nakashima et al. |
| 5,658,401 | A | 8/1997 | Gaag et al. |
| 9,617,629 | B2 | 4/2017 | Kuhn et al. |
| 9,637,808 | B2 | 5/2017 | Huettner et al. |
| 9,738,961 | B2 | 8/2017 | Kuhn et al. |
| 2008/0219881 | A1 | 9/2008 | Gaag |

FOREIGN PATENT DOCUMENTS

| | | | |
|---|---|---|---|
| CH | 700 999 | B1 | 11/2010 |
| DE | 1 120 151 | B | 12/1961 |
| DE | 1 205 285 | B | 11/1965 |
| DE | 42 40 157 | A1 | 6/1994 |
| DE | 10 2012 004 725 | A1 | 9/2013 |
| EP | 0 119 501 | A1 | 9/1984 |
| EP | 0 657 555 | A1 | 6/1995 |
| JP | 1-177327 | A | 7/1989 |
| JP | 3-68732 | A | 3/1991 |
| WO | WO 2006/105910 | A2 | 10/2006 |
| WO | WO 2013/131604 | A2 | 9/2013 |
| WO | WO 2014/187544 | A1 | 11/2014 |

OTHER PUBLICATIONS

International Search Report issued in Application No. PCT/EP2016/001697 with English translation dated Jan. 25, 2017 (7 pages).
Written Opinion of the International Searching Authority issued in Application No. PCT/EP2016/001697 dated Jan. 25, 2017 (4 pages).
Office Action of German Patent Office issued in Application No. 10 2015 014 856.7 dated Nov. 4, 2016 (5 pages).

*Primary Examiner* — Jessee R Roe
(74) *Attorney, Agent, or Firm* — Flynn Thiel, P.C.

(57) ABSTRACT

A copper-nickel-zinc having the following composition in weight percentages: 46.0 to 51.0% Cu, 8.0 to 11.0% Ni, 0.2 to 0.6% Mn, 0.05 to 0.5% Si, up to 0.8% of each of Fe and/or Co, the sum of the Fe content and double the Co content equaling at least 0.1 wt. %, residual Zn, and unavoidable impurities, wherein nickel-, iron-, and manganese-containing and/or nickel-, cobalt-, and manganese-containing mixed silicides are embedded into a microstructure consisting of α- and β-phases as spherical or ellipsoidal particles and uses of such a copper-nickel-zinc alloy.

5 Claims, No Drawings

COPPER-NICKEL-ZINC ALLOY AND USE THEREOF

The invention relates to a copper-nickel-zinc alloy into whose microstructure consisting of α and β phases, nickel, iron- and manganese-containing and/or nickel-, cobalt- and manganese-containing mixed silicides are embedded as spherical or ellipsoidal particles, and also the use of such a copper-nickel-zinc alloy.

Alloys of copper, nickel and zinc are referred to as nickel silver because of their silver-like colors. Industrially usable alloys have from 47 to 64% by weight of copper and from 7 to 25% by weight of nickel. In the case of drillable and borable alloys, up to 3% by weight of lead is usually added as a chip breaker and, in the case of cast alloys, even up to 9% by weight. The balance is zinc. Commercial nickel silver alloys can additionally contain from 0.2 to 0.7% by weight of manganese as additives in order to reduce the heat exposure brittleness. The addition of manganese also has a deoxidizing and desulfurizing effect.

Nickel silver alloys such as CuNi12Zn24 or CuNi18Zn20 are used, inter alia, in the optics industry for producing spectacle hinges. The continuing miniaturization of these products requires materials having a higher strength. In addition, these products have to meet demanding requirements in terms of the quality of the surface.

Nickel silver alloys are also used for the production of jewelry and components for clocks/watches. These products have to meet particularly demanding requirements in terms of the quality of the surface. The material has to have, even in the drawn state, a shiny surface which looks polished and is free of defects, for example grooves or holes. Furthermore, the material has to be very readily machinable and, if necessary, also polishable. The color of the material must also not change during use. Materials which are used in medical technology or for the production of musical instruments have to meet quite similar requirements.

High-strength nickel silver alloys having advantageous properties in respect of castability and hot formability are known from the document DE 1 120 151. These alloys consist of from 0.01 to 5% of Si, from >10 to 30% of Ni, from 45 to 70% of Cu, from 0.3 to 5% of Mn, balance at least 10% of zinc. Small additions of Si serve to deoxidize the alloy and to improve the castability. The addition of manganese has the task of increasing the toughness and thus the cold workability of the alloy, and also serves to save nickel. If desired, manganese can be replaced completely by aluminum, and nickel can be replaced partly by cobalt. The addition of iron as an alloy constituent should be avoided since iron reduces the corrosion resistance of the alloy. At a manganese content of 1%, strength values of about 400 MPa are achieved. To improve the mechanical properties, a heat treatment is proposed.

The document JP 01177327 describes readily machinable nickel silver alloys having good hot and cold formability. These alloys consist of from 6 to 15% of Ni, from 3 to 8% of Mn, from 0.1 to 2.5% of Pb, from 31 to 47% of Zn, the balance being Cu and unavoidable impurities. If desired, small amounts of Fe, Co, B, Si or P can be added in order to prevent grain growth on heating before hot forming.

Lead-containing copper-nickel-zinc alloys in the microstructure of which nickel-, iron- and manganese-containing and/or nickel-, cobalt- and manganese-containing mixed silicides are embedded as spherical or ellipsoidal particles are known from the document DE 10 2012 004 725 A1. The alloys display a high tensile strength, good cold forming capability and good machinability. The proportion of lead of from 1.0 to 1.5% by weight ensures a good machinability of the alloys. The alloys are employed for producing high-quality points for ballpoint pens. The surface properties of the material are not always satisfactory for applications having particularly demanding requirements in terms of the surface quality.

It is an object of the invention to provide a copper-nickel-zinc alloy having an improved surface quality combined with a high strength. The surface should appear as polished, even in the drawn state. Furthermore, the alloy should have a good machinability and excellent color stability. A further object of the invention is to indicate a use for such a copper-nickel-zinc alloy.

The invention is defined in respect of a copper-nickel-zinc alloy by its features, use by the features, advantageous embodiments and further developments.

The invention encompasses a copper-nickel-zinc alloy having the following composition in % by weight:

Cu from 46.0 to 51.0%,
Ni from 8.0 to 11.0%,
Mn from 0.2 to 0.6%,
Si from 0.05 to 0.5%,
Fe and/or Co in each case up to 0.80, where the sum of Fe content and twice the Co content is at least 0.1% by weight,
the balance being Zn and unavoidable impurities,
wherein nickel-, iron- and manganese-containing and/or nickel-, cobalt- and manganese-containing mixed silicides are embedded as spherical or ellipsoidal particles in a microstructure consisting of α and β phases.

The invention starts out from the idea of varying the microstructure of nickel silver materials by the alloying-in of silicon in such a way that silicide precipitates are formed. As intermetallic compounds, silicides have a hardness of about 800 HV which is significantly higher than that of the α and β phases of the matrix microstructure. Manganese is alloyed-in principally to improve the cold and hot forming capability and to increase the strength. In addition, manganese has a deoxidizing and desulfurizing effect. In the simultaneous presence of manganese, iron and nickel, silicon forms mixed silicides having approximate compositions predominantly in the range from $(Mn,Fe,Ni)_2Si$ to $(Mn,Fe,Ni)_3Si$. In an analogous way, silicon forms mixed silicides of the approximate compositions $(Mn,Co,Ni)_xSi_y$, where $x \geq y$, in the simultaneous presence of manganese, cobalt and nickel. Furthermore, it is also possible for mixed silicides containing both iron and cobalt in addition to manganese and nickel to be formed. The mixed silicides are present in finely dispersed form as spherical or ellipsoidal particles in the matrix microstructure. The average of the volume-equivalent diameter of the particles is from 0.5 to 2 μm. The microstructure does not contain any silicides which have a large area and can therefore easily break out from the matrix microstructure. This advantageous property is achieved in the alloy of the invention by, in particular, the small proportions of manganese and iron or cobalt. Both iron and cobalt act as nuclei for silicide formation, i.e. in the presence of iron and/or cobalt, even small deviations from the thermodynamic equilibrium are sufficient for small precipitates to be formed. These precipitate nuclei, which in the case of the present alloy composition can also contain nickel, are finely dispersed in the microstructure. Further silicides which now also contain manganese preferentially become attached to these nuclei. The size of the individual silicides is restricted by the small manganese content of the alloy. Small amounts of iron and/or cobalt in combination with a small amount of manganese are thus the prerequisite for the formation of the mixed silicides. The minimum amount of iron and/or cobalt is defined by the sum of the iron content and twice the cobalt content being at least 0.1% by weight.

It has surprisingly been found that the copper-nickel-zinc alloy of the invention has an excellent surface quality. Even in the drawn state, the surface of the material is very smooth, has a shiny silvery appearance and is free of visible defects. The surface looks as if it had already been polished. The surface of a semifinished part produced by a forming process, for example a drawing or rolling process, from an alloy according to the invention thus in many cases already meets the quality requirements for the end product. Further working to improve the surface is no longer necessary. The average roughness Ra of the surface of such a semifinished part is typically not more than 0.2 μm. The average roughness Ra is determined over a measurement length of at least 4 mm.

The surface quality of the copper-nickel-zinc alloy of the invention is at least as good as that of the materials used hitherto in the optics industry. However, the strength of the copper-nickel-zinc alloy of the invention is significantly greater than that of the materials used hitherto. This increase in the strength allows the components to be made smaller and more finely structured and thus meet current design requirements. The tensile strength of the copper-nickel-zinc alloy of the invention is, depending on the degree of deformation of the material, in the range from 700 to 900 MPa. In the hard state, it is at least 800 MPa.

Workpieces made of a copper-nickel-zinc alloy according to the invention have a very high-quality surface and an appealing appearance, so that this alloy is suitable for producing jewelry and components of clocks/watches. Furthermore, workpieces made of a copper-nickel-zinc alloy according to the invention can be polished very well, as a result of which the optical impression of the workpiece can be improved further if required and the value of the product can be increased. Furthermore, the surface of the copper-nickel-zinc alloy of the invention is readily coatable because of its excellent evenness.

In particular, the surface quality of a copper-nickel-zinc alloy according to the invention is significantly better than that of lead-containing copper-nickel-zinc alloys having a similar composition. Small proportions of lead of up to 0.1% by weight can be present among the impurities in a copper-nickel-zinc alloy according to the invention; these are neither matrix-active nor do they have an influence on the formation of the mixed silicides. The proportion of lead in a copper-nickel-zinc alloy according to the invention is preferably not more than 0.05% by weight. A copper-nickel-zinc alloy according to the invention is particularly preferably lead-free.

A further advantage of a copper-nickel-zinc alloy according to the invention is its high zinc content of about 40% by weight. This makes the material cheaper than, for example, the nickel silver alloys CuNi12Zn24 or CuNi18Zn20.

In addition, a copper-nickel-zinc alloy according to the invention has a good workability. The alloy can readily be formed both hot and cold. The production costs of semifinished parts and end products are reduced thereby. In particular, the copper-nickel-zinc alloy of the invention has very good machinability, even though it contains at most very small amounts of lead. Even at Pb contents which are significantly below the threshold of unavoidable impurities, a copper-nickel-zinc alloy according to the invention is readily machinable. The reason for the good machinability of the alloy are the finely disposed mixed silicides which act as chip breakers.

It can be advantageous for either the Fe content or the Co content to be at least 0.1% by weight. This promotes the formation of finely disposed mixed silicides.

In a preferred embodiment of the invention, the copper-nickel-zinc alloy of the invention can have the following composition (in % by weight):

Cu from 47.5 to 49.5%,
Ni from 8.0 to 10.0%,
Mn from 0.2 to 0.6%,
Si from 0.05 to 0.4%,
Fe from 0.2 to 0.8%,
optionally up to 0.8% of Co,
balance Zn and unavoidable impurities.

At this composition, nickel-, iron- and manganese-containing mixed silicides can be embedded as spherical or ellipsoidal particles in a microstructure consisting of α and β phases. The targeted alloying-in of iron results in the formation of very fine mixed silicides which have an advantageous effect on the surface quality of the material.

In an alternative advantageous embodiment of the invention, the copper-nickel-zinc alloy of the invention can have the following composition (in % by weight):

Cu from 47.5 to 49.5%,
Ni from 8.0 to 10.0%,
Mn from 0.2 to 0.6%,
Si from 0.05 to 0.4%,
Co from 0.1 to 0.8%,
optionally up to 0.8% of Fe,
balance Zn and unavoidable impurities.

At this composition, nickel-, cobalt- and manganese-containing mixed silicides can be embedded as spherical or ellipsoidal particles in a microstructure consisting of α and β phases. The targeted alloying-in of cobalt results in the formation of mixed silicides which have an advantageous effect on the strength of the material combined with a good surface quality.

A further aspect of the invention encompasses the use of an alloy according to the invention for producing consumer goods having demanding requirements in terms of the surface quality, for example jewelry components of clocks/watches, spectacle hinges, musical instruments or instruments for medical technology. Owing to the excellent surface quality of workpieces made of an alloy according to the invention, it is particularly suitable for producing jewelry, components of clocks/watches and musical instruments. In these applications, the high color stability of the alloy is also advantageous. The color stability results from the high corrosion resistance of the alloy. Instruments which are used in medical technology have to be easy to clean. The smoother the surface of the instruments, the more readily can undesirable substances be removed. The combination of good surface quality and high strength predestines the copper-nickel-zinc alloy of the invention for the production of spectacle hinges.

A further aspect of the invention encompasses the use of an alloy according to the invention for producing keys, locks, plug connectors or points for ballpoint pens. In the production of consumer articles such as keys or locks, the advantageous properties of a copper-nickel-zinc alloy according to the invention in respect of workability, namely good formability and good machinability, are brought to bear. The same applies to the use of a copper-nickel-zinc alloy according to the invention as a plug connector which is produced from a profile, a rod or a tube by cutting machining. In the use as a point for ballpoint pens, the good corrosion resistance of the copper-nickel-zinc alloy of the invention is also advantageous.

The invention will be illustrated with the aid of a working example.

A copper-nickel-zinc alloy according to the invention and three comparative alloys were melted and cast to form billets. Wires and rods having an external diameter of 4 mm were produced from the billets by means of hot pressing and cold forming. Table 1 shows the composition of the individual alloys in % by weight.

TABLE 1

Composition of the individual alloys in % by weight

| | Cu | Ni | Mn | Si | Fe | Pb | Zn |
|---|---|---|---|---|---|---|---|
| Inventive alloy | 48.5 | 9.5 | 0.4 | 0.2 | 0.5 | <0.05 | Balance |
| Comparative specimen 1 | 49.0 | 7.5 | 3.0 | — | — | 3.0 | Balance |
| Comparative specimen 2 | 62.5 | 17.5 | 0.4 | — | — | — | Balance |
| Comparative specimen 3 | 48.4 | 9.5 | 0.4 | 0.3 | 0.5 | 1.3 | Balance |

Roughness measurements were carried out on the drawn wires. The following properties were determined over a measurement length of 4 mm, in each case along and transverse to the drawing direction:

Ra average roughness

Rz averaged peak-to-valley height

Rmax maximum peak-to-valley height

Rt total height of the profile

The values determined on the specimens are compared in table 2.

TABLE 2

Measured roughness values, reported in μm

| | Measurement direction | Inventive alloy | Comparative specimen 1 | Comparative specimen 2 | Comparative specimen 3 |
|---|---|---|---|---|---|
| Ra | longitudinal | 0.039 | 0.100 | 0.103 | 0.113 |
| | transverse | 0.174 | 0.315 | 0.182 | 0.317 |
| Rz | longitudinal | 0.36 | 1.48 | 0.76 | 1.56 |
| | transverse | 0.99 | 1.81 | 1.47 | 1.91 |
| Rmax | longitudinal | 0.49 | 2.03 | 1.15 | 2.16 |
| | transverse | 1.28 | 2.29 | 1.92 | 2.42 |
| Rt | longitudinal | 0.56 | 2.05 | 1.15 | 2.17 |
| | transverse | 2.26 | 2.66 | 2.11 | 2.63 |

The measured values documented in table 2 show that the surface of the alloy according to the invention has the lowest roughness or peak-to-valley height in the case of seven of eight measured values. The alloy according to the invention thus has the best surface quality in the drawn state. In particular, the measured values determined on the alloy according to the invention are always lower than the measured values determined on the lead-containing comparative specimens 1 and 3.

Cutting machining tests were carried out on the four specimens. For this purpose, a central drilled hole running parallel to the axis and having an internal diameter of 2 mm was introduced into the wires. The alloy of the invention and also the two lead-containing comparative specimens 1 and 3 could be machined without problems. The drilling chips were fine. The lead-free comparative specimen 2 became very hot in the drilling experiment and the drill broke off during the experiment.

The mechanical properties documented in table 3 were determined on specimens of an alloy according to the invention having a composition as shown in table 1:

TABLE 3

Mechanical properties of an alloy according to the invention

| | Tensile strength $R_m$ | Yield point $R_{p0.2}$ | Elongation at break $A_{10}$ |
|---|---|---|---|
| Round rod, diameter 8 mm | 735 MPa | 561 MPa | 11% |
| Round wire, diameter 2.5 mm | 835 MPa | 619 MPa | 12% |

The experiments show that a copper-nickel-zinc alloy according to the invention advantageously combines properties as are not to be found in this combination in the case of alloys known from the prior art.

The invention claimed is:

1. A copper-nickel-zinc alloy having the following composition, in % by weight:

Cu from 46.0 to 51.0%,

Ni from 8.0 to 11.0%,

Mn from 0.2 to 0.6%,

Si from 0.05 to 0.5%,

Fe and/or Co in each case up to 0.8%, where the sum of Fe content and twice the Co content is at least 0.1%, the balance being Zn and unavoidable impurities, wherein nickel-, iron- and manganese-containing and/or nickel-, cobalt- and manganese-containing mixed silicides are embedded as spherical or ellipsoidal particles in a microstructure consisting of α and β phases.

2. The copper-nickel-zinc alloy as claimed in claim 1 having the following composition, in % by weight:

Cu from 47.5 to 49.5%,

Ni from 8.0 to 10.0%,

Mn from 0.2 to 0.6%,

Si from 0.05 to 0.4%,

Fe from 0.2 to 0.8%, optionally up to 0.8% of Co, the balance being Zn and unavoidable impurities, wherein nickel-, iron- and manganese-containing mixed silicides are embedded as spherical or ellipsoidal particles in a microstructure consisting of α and β phases.

3. The copper-nickel-zinc alloy as claimed in claim 1 having the following composition, in % by weight:

Cu from 47.5 to 49.5%,

Ni from 8.0 to 10.0%,

Mn from 0.2 to 0.6%,

Si from 0.05 to 0.4%,

Co from 0.1 to 0.8%, optionally up to 0.8% of Fe, the balance being Zn and unavoidable impurities, wherein nickel-, cobalt- and manganese-containing mixed silicides are embedded as spherical or ellipsoidal particles in a microstructure consisting of α and β phases.

4. A consumer good having a polished surface finish that is free of visible defects, wherein said consumer good is made of the copper-nickel-zinc alloy of claim 1.

5. A key, lock, plug connector or point for a ballpoint pen, wherein said key, lock, plug connector or point for a ballpoint pen is made of the copper-nickel-zinc alloy of claim 1.

* * * * *